US008006628B2

(12) United States Patent
Tomada et al.

(10) Patent No.: US 8,006,628 B2
(45) Date of Patent: Aug. 30, 2011

(54) VEHICLE LIFTING APPARATUS

(75) Inventors: Tokumitsu Tomada, Mihara (JP); Masahiro Inui, Mihara (JP); Masaya Nishino, Mihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 221 days.

(21) Appl. No.: 12/385,379

(22) Filed: Apr. 7, 2009

(65) Prior Publication Data

US 2010/0251926 A1 Oct. 7, 2010

(51) Int. Cl.
*B61D 23/00* (2006.01)

(52) U.S. Cl. ..... 105/447; 105/449

(58) Field of Classification Search ..... 105/437, 105/438, 439, 440, 443, 444, 445, 446, 449, 105/450; 280/163, 164.1, 166; 14/71.1, 14/69.5; 182/106, 127, 82, 88; 296/62; 414/545
See application file for complete search history.

(56) References Cited

U.S. PATENT DOCUMENTS 4,615,275 A * 10/1986 Ishizuka ..... 105/438
5,803,523 A * 9/1998 Clark et al. ..... 296/26.1
5,813,071 A * 9/1998 Breslin et al. ..... 14/71.1
6,964,444 B2 * 11/2005 Chumley et al. ..... 296/26.08
7,556,303 B2 * 7/2009 Waldner et al. ..... 296/51

FOREIGN PATENT DOCUMENTS

| | | |
|---|---|---|
| JP | H11-321643 | 11/1999 |
| JP | 2000-144643 | 5/2000 |
| JP | 2001-315640 | 11/2001 |
| JP | 2003-301680 | 10/2003 |

* cited by examiner

*Primary Examiner* — Mark T Le
(74) *Attorney, Agent, or Firm* — Manabu Kanesaka; Benjamin J. Hauptman; Kenneth M. Berner

(57) ABSTRACT

An emergency staircase includes a plurality of step forming members that are housed in a casing. A podium and a railing are fitted to the casing so that the podium and the railing can be unfolded against the casing. Each of the step forming members includes a pair of guiding parts which are arranged in parallel, and a step plate that is sandwiched between the guiding parts of each pair and fastened to each of the guiding parts, so that left and right pairs of resulting squarish U-shapes face each other. Inner guiding parts and outer guiding parts are mutually of a similar configuration, so that each inner one is relatively smaller than each outer one by the thickness of the part. The protrusions act as sliding contacts between adjacent guiding parts.

9 Claims, 14 Drawing Sheets

VEHICLE LIFTING APPARATUS

BACKGROUND OF THE INVENTION

1. Field of the Invention

The present invention relates to a vehicle detrainment apparatus (emergency staircase) that is provided in a passenger train and used in an emergency case so that the passengers can descend from the train or ascend thereto, through the staircase with a plurality of footsteps 2. Description of the Related Art A passenger train that runs on a guideway is provided with an emergency exit for making the passengers escape from the train and an emergency footstep device for making the passengers descend to the guideway through the emergency exit for an emergency. The guideway to which the passengers descend is so bumpy that the passengers have a difficulty in walking stably on the guideway; and the emergency situation itself makes the passengers feel insecure; accordingly, it is requested that the emergency footstep device can make the passenger quickly escape, without anxiety.

In recent years, what is called a new transportation system as a medium-capacity transit system has become commonplace whereby a rubber tired passenger train runs on an exclusive guideway; in the new transportation system, the train is usually operated automatically without the assistance of an attendant, in the great majority of cases; in a particular case as an example, the train has the guide wheels that are guided by the guideway.

The emergency footstep device adopted for the new transportation system is provided with a plurality of step forming members whereby each adjacent pair of the step forming members can slide on each other; the emergency footstep device is configured so that the step forming members are laid down toward the outside of the train from the inside thereof. Further, the emergency footstep device is provided with a pair of slide guide pipes that guide the step forming members to slide, the slide guide pipes being placed on both sides of the emergency footstep device; thereby, the space housing the slide guide pipes is required; accordingly, the width of each step forming member has to be limited; thus, the number of the footsteps is limited to at most three. As a result, a steep slope angle such as around sixty degrees against the guideway surface has to be introduced.

On the other hand, the emergency footstep device adopted for the railcars and the like is housed below the coach floor; a person in charge draws the device toward outside and hangs the device on the coach body in case of emergency; till then, the passengers cannot escape from the coach.

In the patent reference 1 (JP2001-315640), an emergency ladder device is disclosed; thereby, the device is housed below the coach floor, and the ladder can be drawn so as to slide in the direction parallel to the rail ties; after the ladder has drawn outside, it is rotated around a rotation axis therein, and an outer end of the ladder is landed to the running surface so that the ladder is placed at a predetermined angle with respect to the ground surface; then, the ladder is pushed against the coach so that the ladder is locked with the predetermined angle.

In the patent reference 2 (JP1999-321643), an emergency escape device for railcars is disclosed; thereby, the device is provided with an air-filled escape shoot that expands by means of the ejected air; in normal times, the air is exhausted from the shoot, and the shoot is folded up. In an emergency, the door of the coach is opened, the shoot is thrown outside, and the shoot is filled with air so that the passenger can slide down on the shoot.

In the above-described emergency footstep device adopted for the new transportation system, a steep slope angle such as around sixty degrees against the running surface has to be introduced, whereas the escaping passengers have to descend from the coach floor that is located more than 1.0 m above the running surface; thus, the passengers have a difficulty in watching the steps below, unless the passengers lean forward. Therefore, the passengers feel anxious; in particular, the elderly passengers, women, or children are frightened so that a smooth evacuation may be hindered.

Moreover, the step-to-step distance is long because of the small number of the steps, while the width of the footsteps is narrow; and, the emergency footstep device is not provided with a railing (a handrail); in this way, the emergency footstep device adopted for the new transportation system also have the problems as described above. Further, in the footstep device, the longitudinal length of the slide guide pipes that guide the step forming members to slide cannot be increased from a structural point of view: the longer the pipes the larger the diameter; the larger diameter brings the narrower width of the footsteps. In addition, since the slide guide pipes are supported with ricketiness due to somewhat larger clearances around the pipes, the footstep device is bent downward when the passengers tread on the footsteps; thus, the passengers feel more anxious.

The emergency ladder device that are adopted for usual railcars cannot be manipulated inside the coach as is the case in the patent reference 1; thus, the passengers cannot escape from the coach until a person in charge accesses the device, draws the device toward outside, and hangs the device on the coach body. In this way, the passengers have to be kept waiting in the feelings of anxiety.

Further, another problem accompanies the ladder device of the patent reference 1; namely, complicated handling steps (procedures) are required: dismantling the cover of the device, drawing the heavy ladder in the lateral direction, rotating the ladder, and leaning the ladder against the coach body.

Furthermore, other problems accompany the air-filled escape shoot of the patent reference 2; firstly, air-filling time is required; secondly, the shoot is too short for the passengers to stretch themselves on the shoot; thus, as soon as the passengers start shooting, their feet reach the ground with a shock through which the passengers may sprain their ankle.

SUMMARY OF THE INVENTION

In view of the conventional subjects as described above, the present invention aims at providing an emergency staircase, whereby the passengers descend out of the train, through the staircase, without a feeling of anxiety; further, the staircase is easily and promptly arranged from the moment of a standby condition to the moment of a service condition.

A first mode of the present invention as a measure to settle the subjects as described above is an emergency staircase for trains that is provided at an opening of a train, the staircase comprising a plurality of step forming members, so that the adjacent step forming members slide on each other, the step forming members are extended so as to land on the guideway surface, and the step forming members form a plurality of step plates; wherein, each of the step forming members comprises:

a pair of guiding parts, the parts being arranged each other in parallel;

a step plate that is sandwiched between the guiding parts of each pair as well as fastened to each of the guiding parts so as to be integrated into the step forming member; thereby, the cross section of each guiding part is of a squarish U-shape;

the opening as to the U-shape of each guiding part faces the opening as to the squarish U-shape of the other guiding part of the pair;

the adjacent guiding parts as to the adjacent step forming members form a similar figure except that the outer size of the inner guiding part is smaller than the outer size of the outer guiding part, in response to the thickness of the guiding part as well as the height of a plurality of protrusions that are provided on the surface of guiding parts, between the adjacent guiding parts, so that the protrusions act as sliding contact lines of the mutual sliding movement as to the adjacent guiding parts.

According to the above-described first mode, a slide mechanism that makes the adjacent guiding parts slide mutually in a smooth movement is performed by the plurality of protrusions that are integrated into the guiding parts, apart from a conventional manner where a slide mechanism independent of the sliding parts (e.g. the step forming members or the guiding parts) is provided; thus, the clearance between the adjacent guiding parts can be kept small without decreasing the distance of each left and right pair of the guiding parts as well as without increasing the size (depth) of the multilayered (laminated) guiding parts.

Thus, the number of the step forming members can be increased, without an increased housing space for the members; accordingly, the number of footsteps can be increased, and the distance between the footsteps can be decreased; further, with the increased number of the footsteps, the slope of the stairway, that is formed by the extended step forming members, against the guideway surface can be gentle; furthermore, the width of the footstep can be increased; as a result, the passengers can descend the stairway with a feeling of security.

Further, the width of the footstep can be increased; the rigidity of the stairway can be enhanced. Moreover, the sliding movement between the adjacent guiding parts is performed through the protrusions provided on the guiding parts, so that the protrusions slide on the adjacent guiding part; thus, the clearance between the guiding parts is secured; and, it becomes easy to prevent a foreign substance from entering the clearance between the guiding parts.

In the following place, a second aspect of the first mode is an emergency staircase, whereby a casing that houses the plurality of step forming members is provided so as to be laid down on the floor at the opening of the train, by being rotated around an axis;

the step forming member that is positioned at the uppermost place when the step forming members are used is supported by the casing, so as to rotate against the casing, around an hinge-pin of a hinge connecting the casing and the step forming member;

after the casing is laid down, the plurality of step forming members are rotated against the casing as the uppermost step forming member is rotated against the casing, so as to be landed on the guideway surface.

Thus, an operator of the emergency staircase can do without any heavy work from the moment the step forming members are housed in the casing to the moment the members are landed on the guideway; what is more, the time required in operating the emergency staircase can be short, and the operation is simple.

In the following place, a third aspect of the first mode is an emergency staircase, whereby the casing is provide with a foldable podium and a foldable railing that are set up in the vertical direction when the casing is laid down on the floor, so as to sandwich an escape passage to be made, from both right and left sides thereof;

the podium serves as a storage cover for the emergency staircase when the step forming members are housed in the casing.

Thus, when the staircase is used, the podium and the railing can protrude toward the outward of the train; the passengers can hang on the podium or the railing, in descending the stairway; and, the passengers can get out of the train with a feeling of security. As a matter of course, with additional rails provided on the podium, the passengers can further easily descend or ascend the stairway.

In the following place, a third aspect of the first mode is repeated so as to confirm the effectiveness thereof; namely, the aspect is an emergency staircase, whereby the casing is provide with a foldable podium and a foldable railing that are set up in the vertical direction when the casing is laid down on the floor, so as to sandwich an escape passage to be made, from both right and left sides thereof;

the podium serves as a storage cover for the emergency staircase when the step forming members are housed in the casing.

Further, according to this configuration, the emergency staircase is installed upright in normal times when the staircase is not used; and, the podium is arranged so as to serve as an interior wall in the coach. Thus, the beauty of the coach inside can be not spoiled.

In the following place, a fourth aspect of the first mode is an emergency staircase, whereby the casing is installed so as to be rotated around a vertical axis that is placed on one side of the casing.

Thus, the casing is provided so that it can rotate around the vertical axis that is placed; therefore, the emergency exit can be promptly accessed, serving as not only a useful exit but also an entrance for a rescue operation in an emergency.

In the following place, a fifth aspect of the first mode is an emergency staircase, whereby a rope is stretched from the podium to the lowermost step forming member out of the plurality of the step forming members, when the step plates as footsteps are used.

Thus, with the aid of the stretched rope, the passengers can easily descend or ascend the stairway.

In the following place, the second mode of the present invention is an emergency staircase, whereby the protrusions are configured with a low friction resin such as PTFE (polytetrafluoroethylene) or an elastic material.

Thus, the adjacent guiding parts can smoothly slide on each other, and the wear of the protrusion parts can be controlled; further, the unpleasant noises accompanied by metal-to-metal contacts can be prevented.

The present invention discloses an emergency staircase for trains that is provided at an opening of a train, the staircase comprising a plurality of step forming members, so that the adjacent step forming members slide on each other, the step forming members are extended so as to land on the guideway surface, and the step forming members form a plurality of step plates; wherein, each of the step forming members comprises:

a pair of guiding parts, the parts being arranged each other in parallel;

a step plate that is sandwiched between the guiding parts of each pair as well as fastened to each of the guiding parts so as to be integrated into the step forming member; thereby, the cross section of each guiding part is of a squarish U-shape;

the opening as to the U-shape of each guiding part faces the opening as to the squarish U-shape of the counter guiding part of the pair;

the adjacent guiding parts as to the adjacent step forming members form a similar figure except that the outer size of the inner guiding part is smaller than the outer size of the outer guiding part, in response to the thickness of the guiding part as well as the height of a plurality of protrusions that are provided on the surface of guiding parts, between the adjacent guiding parts, so that the protrusions act as sliding contact lines of the mutual sliding movement as to the adjacent guiding parts.

Thus, the protrusions guide the relative sliding movements between the adjacent guiding parts; accordingly, each relative distance between the adjacent guiding parts can be kept small; the number of the step forming members can be increased, without an increased housing space for the members; the number of footsteps can be increased.

Further, with the increased number of the footsteps, the slope of the stairway that is formed by the extended step forming members, against the guideway surface can be gentle; furthermore, the width of the footstep can be increased. As a result, the passengers can use the staircase with a feeling of security.

BRIEF DESCRIPTION OF THE DRAWINGS

The present invention will now be described in greater detail with reference to the preferred embodiments of the invention and the accompanying drawings, wherein:

FIG. 6A shows a perspective view of the emergency staircase before it is made use of;

FIG. 6B shows a perspective view of the emergency staircase when it starts being made use of;

According to a second embodiment of the present invention.

The items with the numerals in the figures are explained as follows:

DETAILED DESCRIPTION OF THE PREFERRED EMBODIMENTS

Hereafter, the present invention will be described in detail with reference to the embodiments shown in the figures. However, the dimensions, materials, shape, the relative placement and so on of a component described in these embodiments shall not be construed as limiting the scope of the invention thereto, unless especially specific mention is made.

First Embodiment

Figure 1:
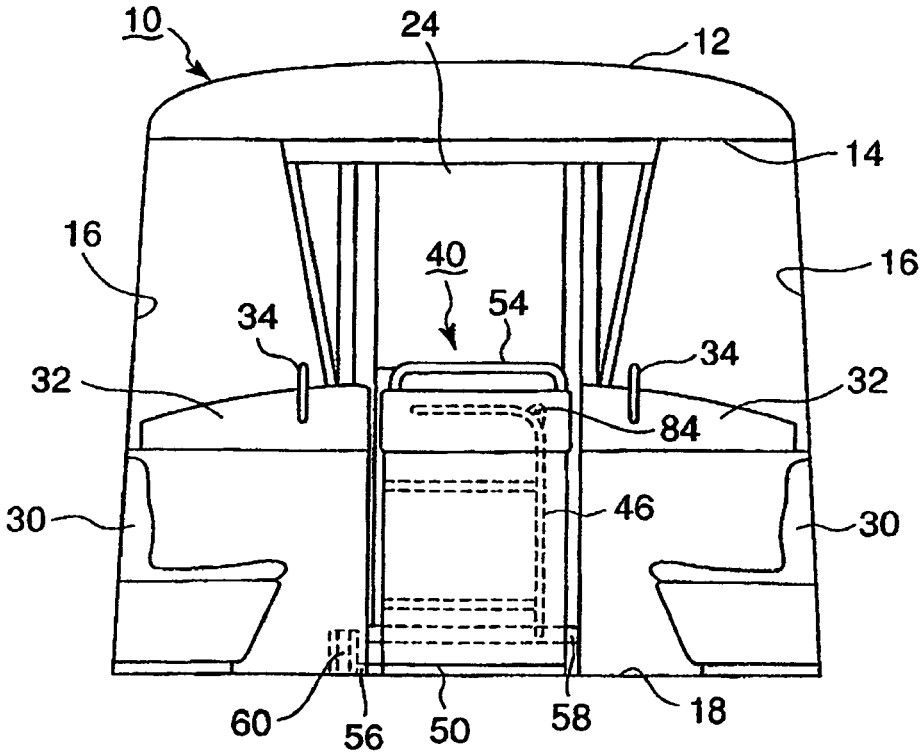
FIG. 1 shows a front view of an emergency staircase as to a first embodiment of the present invention.
Figure 2:
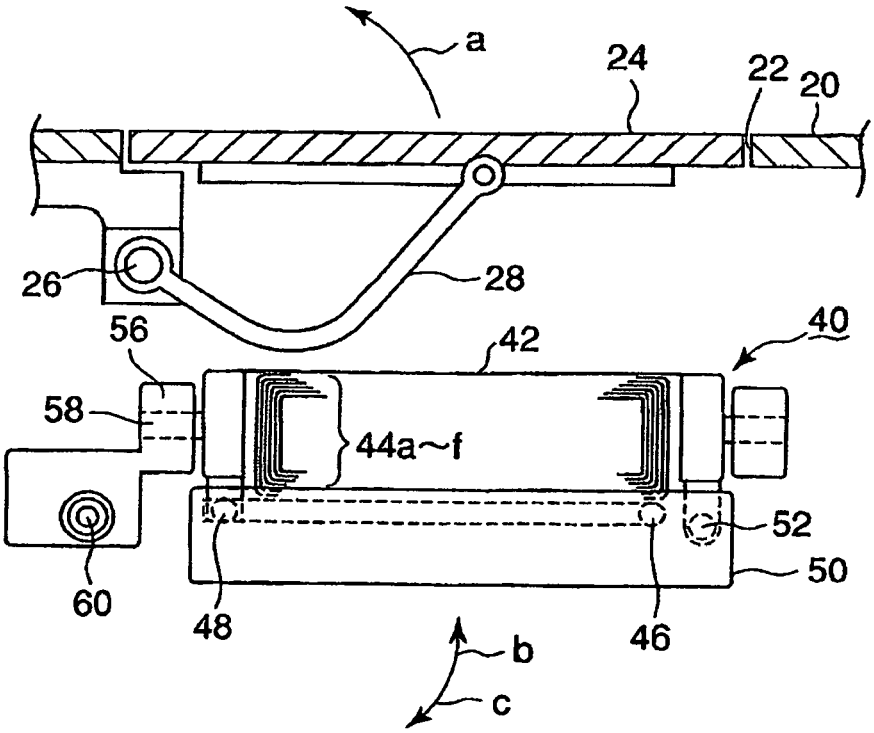
FIG. 2 shows a top view of the emergency staircase.
Figure 3:
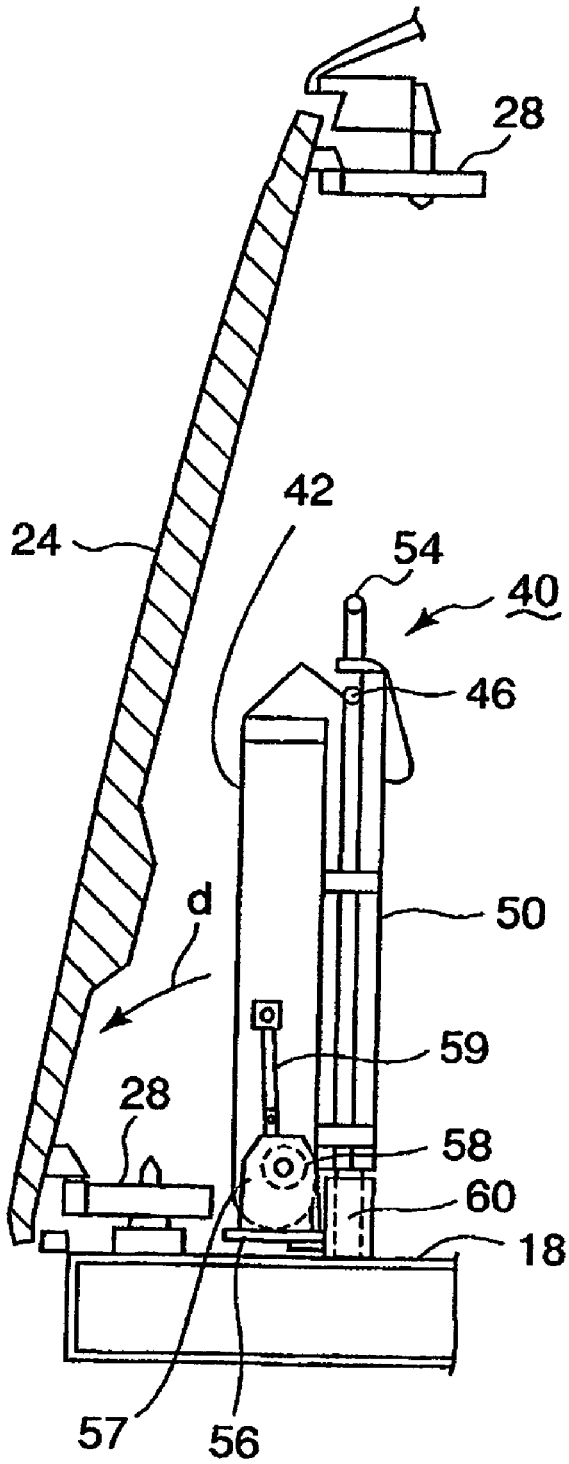
FIG. 3 shows a side view of the emergency staircase.

According to the present invention, the first embodiment that is applied to a coach of the new transportation system is now explained based on FIGS. 1 to 11. FIGS. 1 to 3 show an emergency staircase as to a first embodiment of the present invention, whereby the emergency staircase is seen from the inside of the coach; the staircase is provided at the front end and/or rear end of the train.

As depicted in FIG. 1, the inside space of the coach 10 is surrounded by a ceiling 14 under a roof 12, a pair of sides 16, and a floor 18. At train front 20, an emergency exit 22 is provided; further, an emergency door 24 is provided so as to close the emergency exit 22.A pair of shelves 32 as well as a pair of handrails 34 is provided on the train front and/or rear.

As depicted in FIGS. 2 and 3, an end of boomerang-shaped arms 28 are connected to an upper part and a lower part of the inside face of the emergency door 24; another end of each arm 28 is connected to one of spindles that are fitted to the inside front face of the train 10

As depicted in FIGS. 2 and 3, two boomerang-shaped arms 28 are provided; an end of each arm 28 is connected to an upper part or a lower part of the inside face of the emergency door 24; another end of each arm 28 is connected to an upper part or a lower part of the inside face of the train front, through a jig (not shown) and a spindle 26 installed therein; each arm 28 can turn around the corresponding spindle 26. By pushing the boomerang-shaped arms 28 toward the front, the emergency door 24 performs a translational movement along the a-arrow direction; thus, the emergency door 24 can be opened.

Figure 6A:
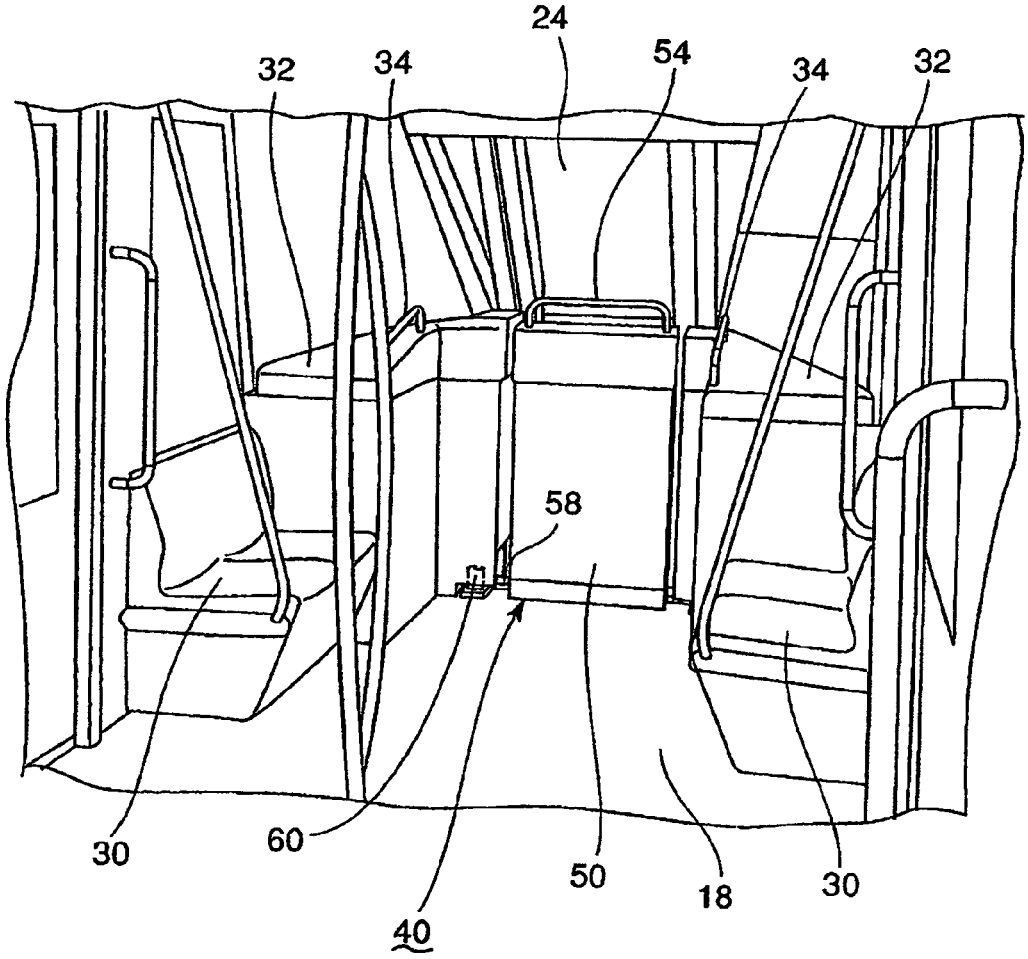

An emergency staircase 40 according to the first embodiment is provided in front of the emergency door 24; the staircase 40 comprises a casing 42 that houses six step forming members from 44*a* to 44*f*. A railing 46 is fitted to the casing 42 so as to move rotationally around an axis 48 as a rotation center, in the b- and c-directions in FIG. 2; a podium 50 is fitted to the casing 42 so as to cover the railing 46 and move rotationally around an axis 52 as a rotation center. When the emergency staircase 40 is not used, the railing 46 and the podium 50 are folded up so as to keep in contact with the casing 42; in addition, the railing 46 is covered with the podium 50. As depicted in FIG. 6A, the podium 50 configures a part of the inner wall of the train front 20; a rail 54 is fastened to the top of the podium 50 so that the passengers catch hold of the rail, when escaping.

The casing 42, the railing 46 fitted to the casing 42, and the podium 50 also fitted to the casing are fitted to a base plate 56, via a level axis 58; the members 42, 46, and 50 together can be rotationally laid down into a horizontal direction, on the floor, around the level axis 58 as a rotation center, along the d-arrow direction in FIG. 3. A bracket 57 is fastened to the base plate 56 so as to be integrated with the base plate 56; a shock absorber 59 is provided so as to connect the bracket 57 with the casing 42, whereby the shock absorber 59 absorbs the shock that is caused to the floor 18, when the casing 42 is laid down.

Figure 6B:
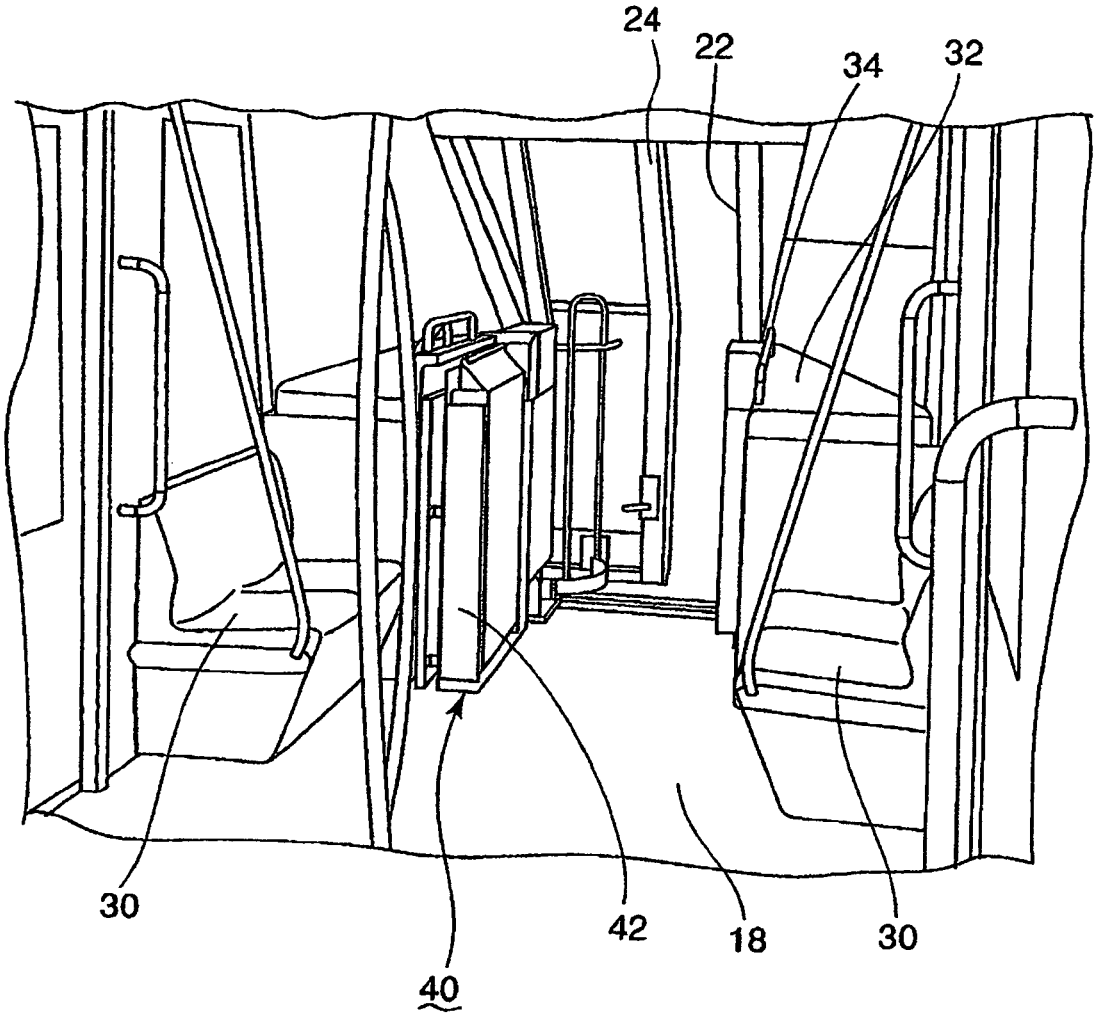

The base plate 56 is connected to a vertical axis 60 so that the plate 56 can rotationally move around the axis 60. The axis 60 is placed in a neighborhood of one side of the casing 42; thus, as depicted in FIG. 6B, the emergency staircase 40 can be rotated around the vertical axis 60 so that the passengers can access the emergency exit and open the emergency door 22.

Figure 4:
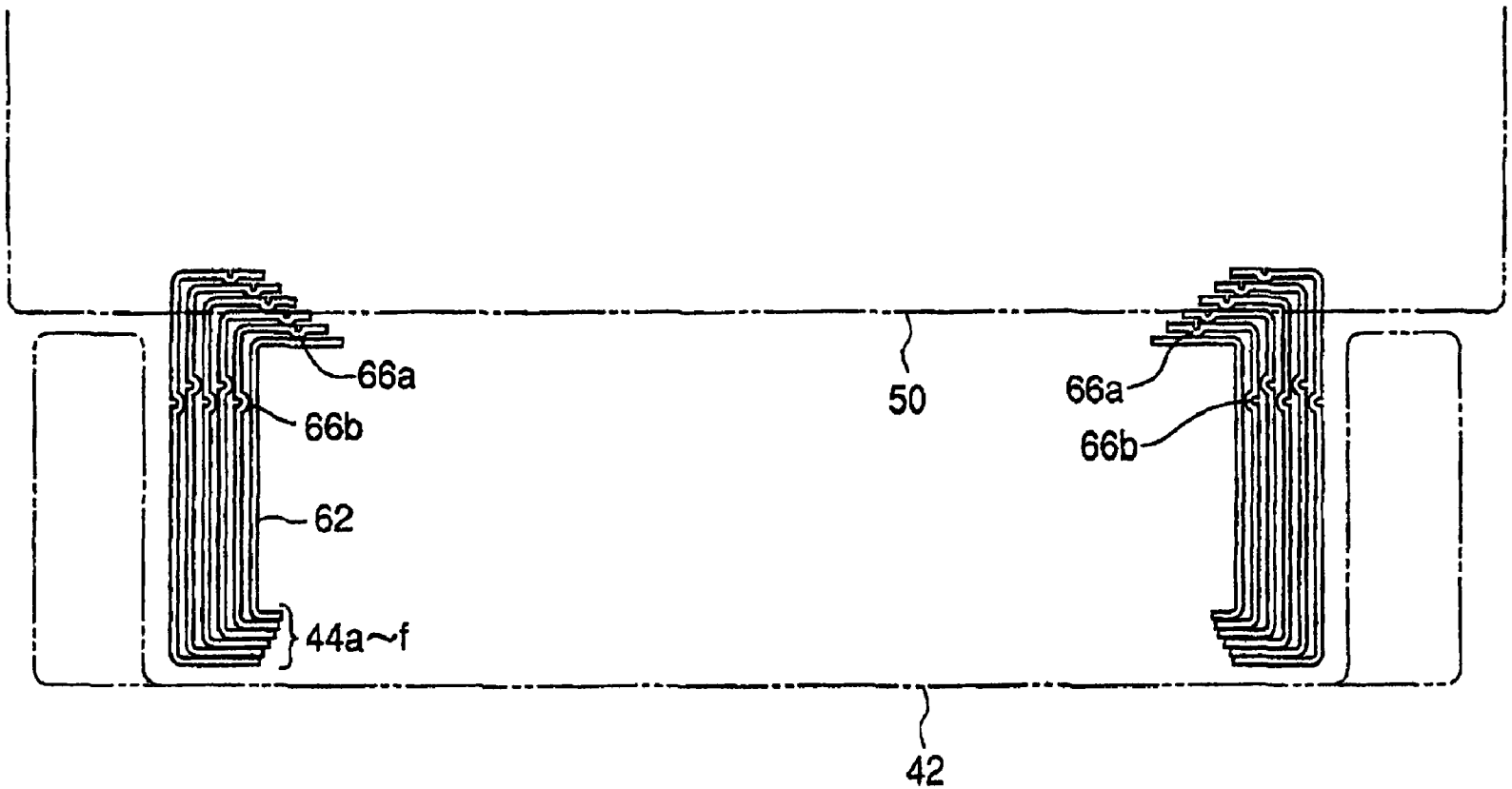
FIG. 4 shows a front view of a plurality of step forming members in the emergency staircase, the view being seen from the outside of the train when the staircase is laid down in a lateral direction.
Figure 5:
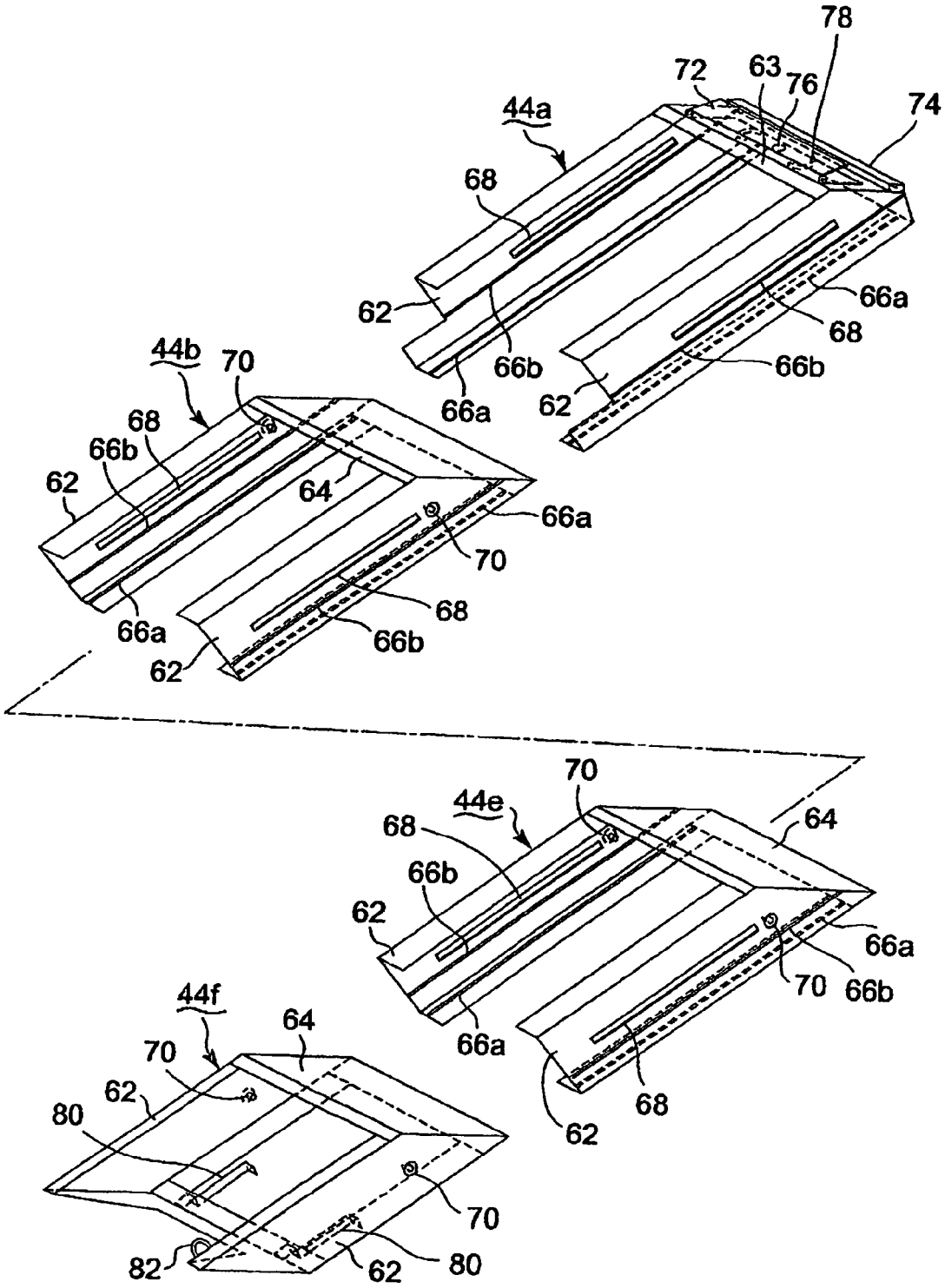
FIG. 5 shows a perspective view of the step forming members when they are developed in the longitudinal direction.

In the next place, the configuration of the step forming members from 44*a* to 44*f* is now explained based on FIGS. 4 and 5. It is noted that the members from 44*c* to 44*d* that form the middle portion out of the members from 44*a* to 44*f* are omitted in FIG. 5.

As shown in FIGS. 4 and 5, each of the six step forming members from 44*a* to 44*f* comprises:

a pair of guiding parts 62, and a step plate 64 that is sandwiched between the pair of the guiding parts 62 as well as fastened to each of the guiding parts 62 so as to be integrated into the step forming member.

The cross section of each guiding part 62 is of a squarish (an angular) U-shape; one side of the pair guiding parts 62 is arranged so as to make the opening of the squarish U-shape face the counter side of the other guiding parts.

A set of adjacent guiding parts 62 such as a set of the guiding part of the step forming member 44*a* and the guiding part of the step forming member 44*b* forms a similar figure; however, the size of the inner adjacent guiding part is smaller than that of the outer adjacent guiding part, by the plate thickness of the guiding part 62; the adjacent guiding parts can slide relatively on each other.

As shown in FIG. 4, a linear protrusion 66*a* and a linear protrusion 66*b* are provided along the longitudinal slide-direction, toward the inner side of each step forming member 44*a*, 44*b*, 44*c*, 44*d*, or 44*e*, at each guiding part 62 except the guiding part of the innermost step forming member 44*f*. As depicted in the cross section in FIG. 4, the linear protrusions 66*a* and 66*b* of a guiding part are arranged so that the protrusions are shifted from the corresponding protrusions of the adjacent guide member; the linear protrusions 66*a* and 66*b* keep the minute clearance between a guiding part 62 and the adjacent guiding parts 62. Thus, in sliding, a guiding part 62 is guided by the linear protrusions 66*a* and 66*b* of the adjacent guiding part; thereby the linear protrusions 66*a* and 66*b* keep in contact with the adjacent guiding part 62.

Each pair of guide parts 62 of the step forming members except the innermost step forming member 44*f*, namely, of the step forming members from 44*a* to 44*e*, is perforated with a pair of long slits 68 in the longitudinal direction of the step forming members.

The step forming members except the outermost step forming member 44*a*, namely, the step forming members from 44*b* to 44*f* are provided with a pin 70 that protrudes outward and is loosely fit into the long slit 68 of the adjacent outer step forming member. When the guiding part 62 is developed or folded in the longitudinal direction, the pin 70 slides in the long slit 68 of the adjacent outer step forming member; and the movement of the step forming member is stopped when the pin 70 strikes an end of the long slit.

Figure 10:
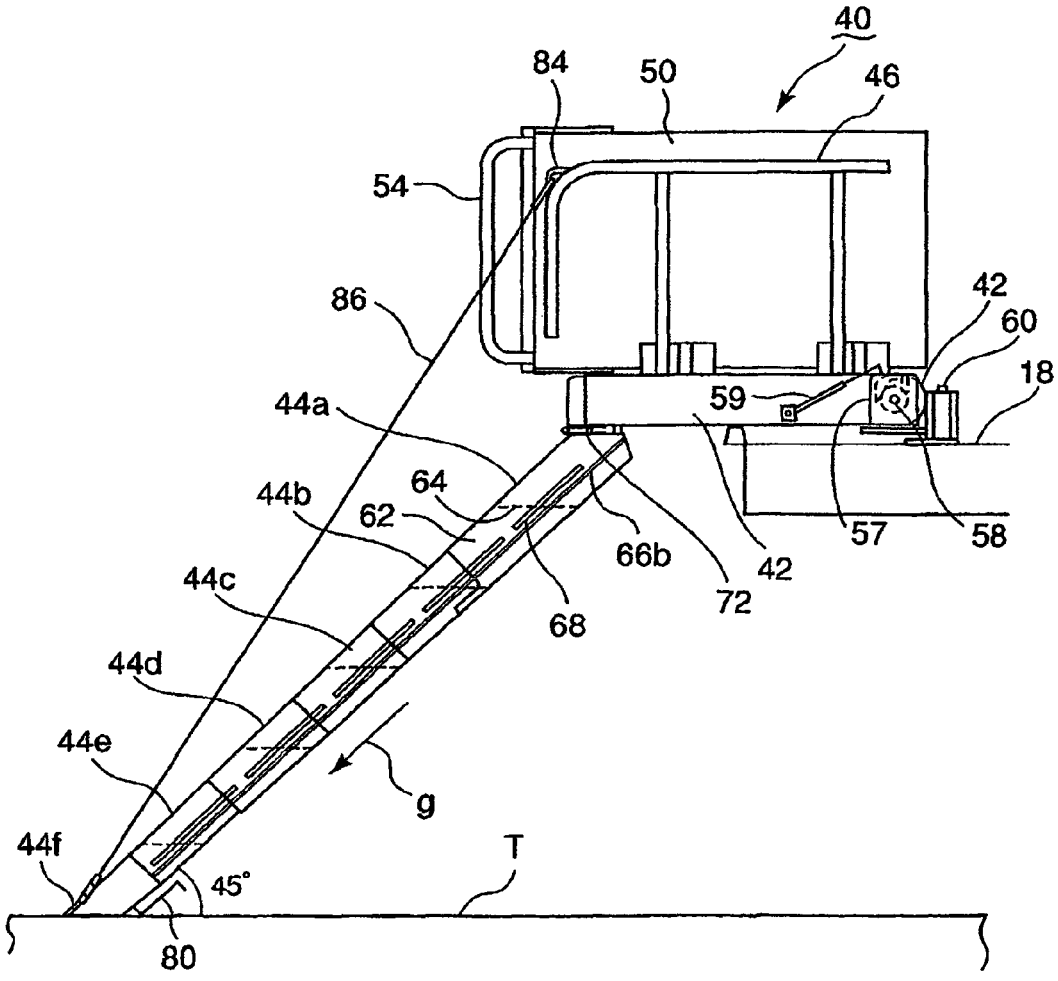
FIG. 10 shows a side view of the emergency staircase when the step forming members is developed and landed.

An upper plate 63 is provided in the outermost step forming member 44*a*, whereby the upper plate 63 attached to the casing 42, via hinge 72, so that the upper plate can rotate (around a pin of the hinge 72); whereby, the upper plate turns around the pin of the hinge so as to come into contact with the underside of the casing when the casing is laid down on the coach floor (see FIG. 10). Further, the upper plate 63 is provided with a rubber stopper 74 on the outer surface of the upper plate so that the rubber stopper 74 absorbs the shock when the upper plate 63 is rotated in an emergency and collides with the underside of the casing.

The upper plate 63 is perforated with a rotation center pin-hole 76 at the middle part of the plate 63; and, the upper plate 63 is perforated with a pair of arc slits 78, on both sides of the rotation center pin-hole 76; a pin (not shown) that is fastened to the hinge protrudes loosely through the rotation center pin-hole 76, the protrusion top of the pin being squeezed or having larger head in comparison with the pin hole diameter so that the upper plate 63 is connected to the hinge and does not fall from the hinge; a pair of pins (not shown) that is fastened to the hinge protrudes loosely through the pair of arc slits 78, the protrusion top of the pins being squeezed or having larger head in comparison with the slit width so that the upper plate 63 is connected to the hinge and does not fall from the hinge. Thus, the step forming members from 44*a* to 44*f* can rotate relatively against the casing 42 around the axis of the pin that protrudes the rotation center pin-hole 76, in the h- or i-arrow direction in FIG. 11 that will be explained later. Thus, the position where the step forming-members reach the guideway surface T (see FIG. 10) can be adjustable.

A pair of ricketiness control plates 80 is installed on the undersurface of the innermost step forming member 44*f* (see FIG. 5 and FIG. 10); the plates 80 are used so as to restraint rickety movements among the step forming members 44*a* to 44*f* through being pressed from the back, when the members are housed in the casing 42.

From the operation-procedural point of view, the configuration as to the emergency staircase 40 will now be explained based on FIGS. 6A to 6F, and FIGS. 7 to 11. FIG. 6A depicts the inside and train front-side of the coach before the emergency staircase is not used; the podium 50 of the emergency staircase 40 forms a part of the inner wall of the train front 20.

In an emergency such as a (train) breakdown, as depicted in FIG. 6B, the emergency staircase 40 is rotated around the vertical axis 60, toward inside, so that the passengers can access the emergency exit and open the emergency door 24. Secondary, the emergency door 24 is unlocked; the arms 28 are pushed forward; the emergency door 24 is opened toward the outside of the train, in a translational movement.

Figure 6C:
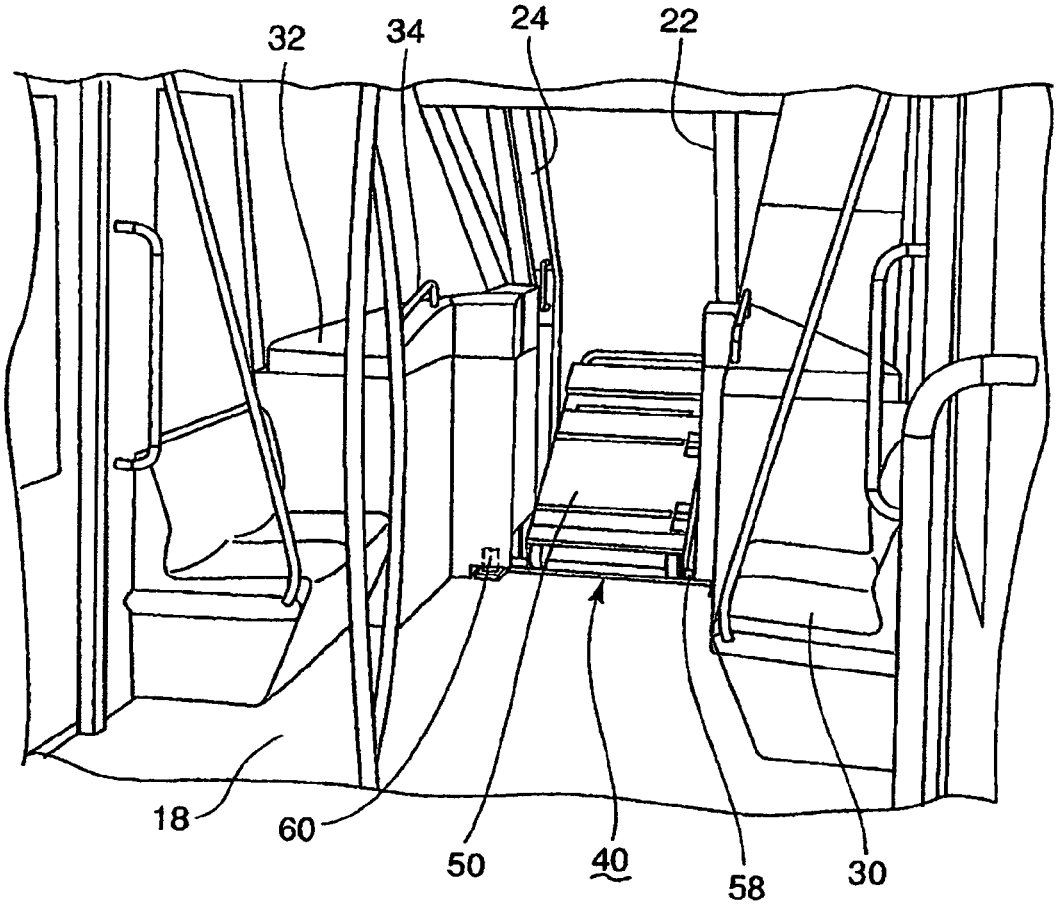
FIG. 6C shows a perspective view of the emergency staircase while it is being laid down (being reclined)
Figure 6D:
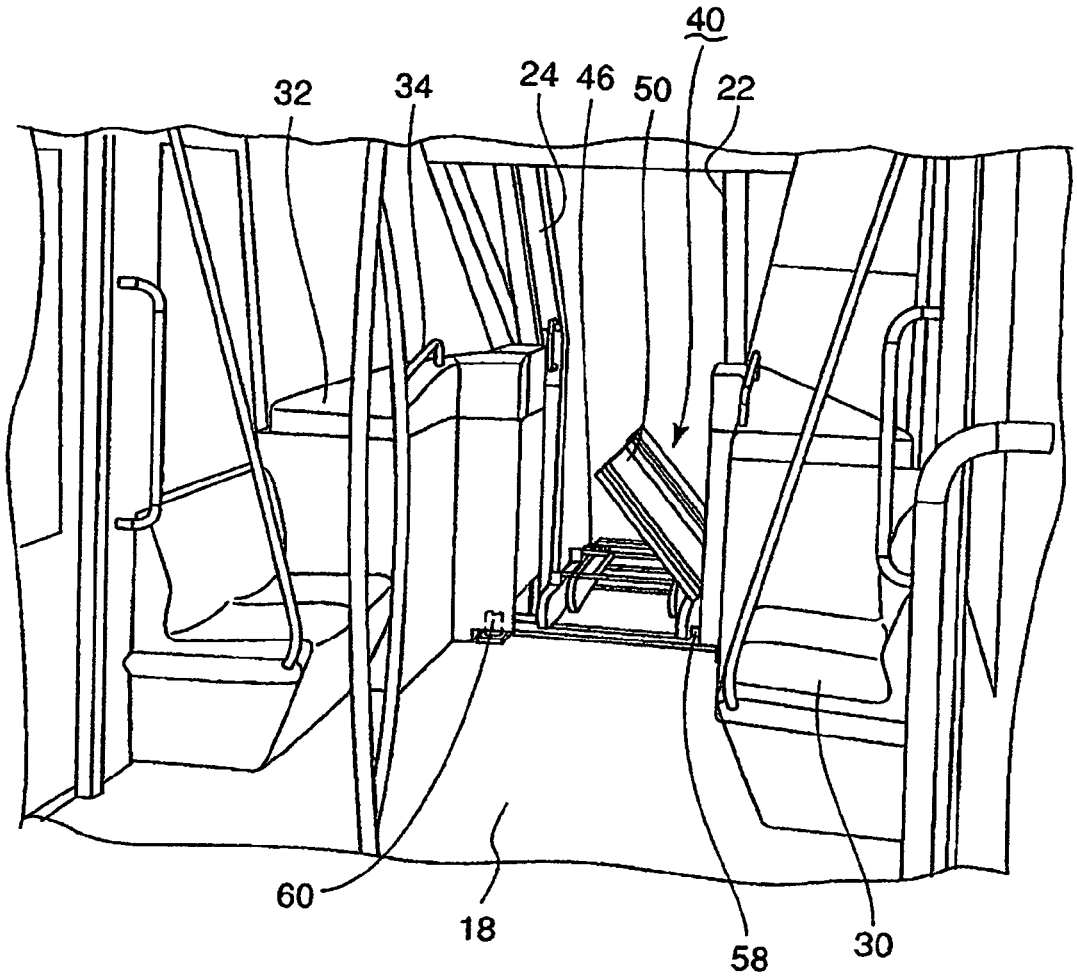
FIG. 6D shows a perspective view of the emergency staircase while the podium thereof is being set up (raised) after the staircase has been laid down (being reclined)
Figure 7:
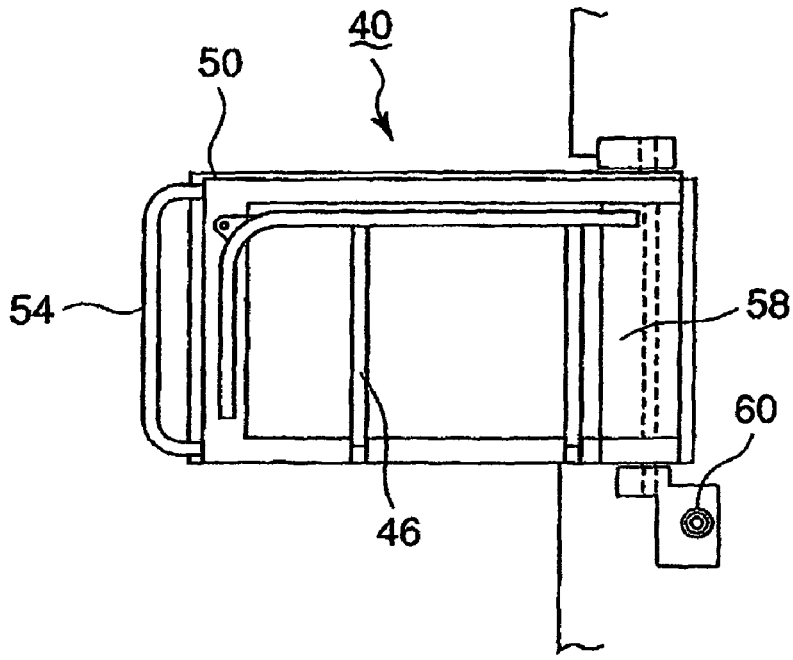
FIG. 7 shows a top view of the emergency staircase when it has been laid down.
Figure 8:
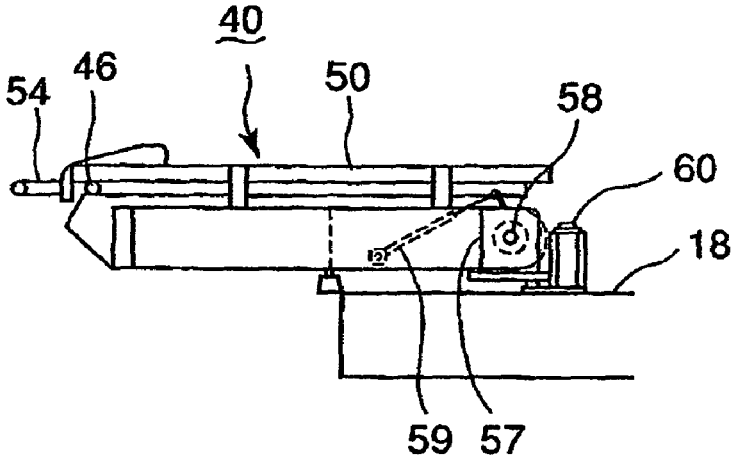
FIG. 8 shows a side view of the emergency staircase when it has been laid down.

Further, the emergency staircase 40 is put back into its original position; as depicted in FIG. 6C, the emergency staircase 40 is laid down around the level axis 58 as a rotation center, the casing protruding toward the outside of the train, through the emergency exit 22; the situation when the emergency staircase 40 is laid down is shown in FIGS. 7 and 8.

Figure 6E:
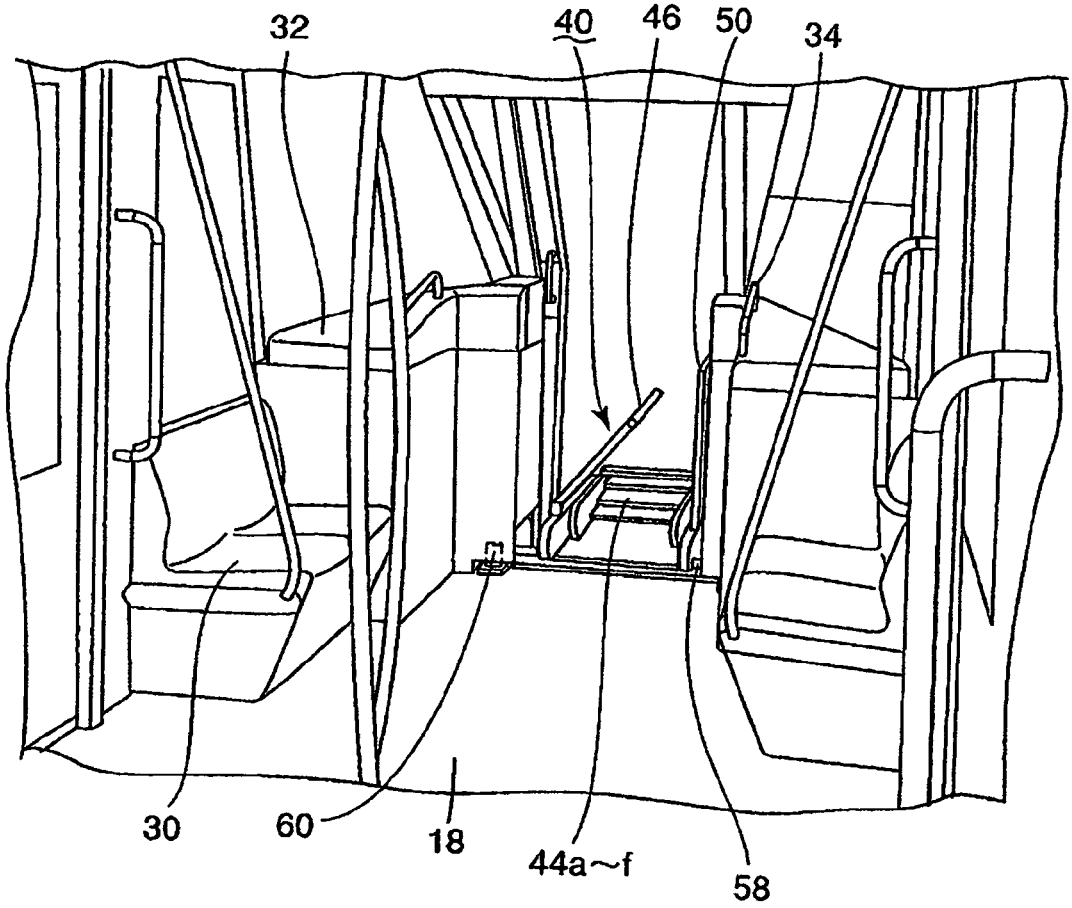
FIG. 6E shows a perspective view of the emergency staircase while the railing thereof is being set up (raised) after the podium has been set up (raised)
Figure 9:
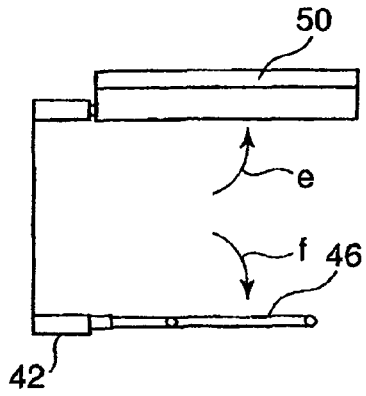
FIG. 9 shows a front view of the emergency staircase; when the step forming members is developed and landed.

Further, as depicted in FIG. 9, the podium 50 is rotated in the e-arrow direction so as to be set up (raised) from the folded-up state; and the podium 50 is fixed in that position (see FIG. 6D); then, the railing 46 is rotated in the f-arrow direction so as to be set up (raised); and the railing 46 is fixed in that position (see FIG. 6E).

Figure 6F:
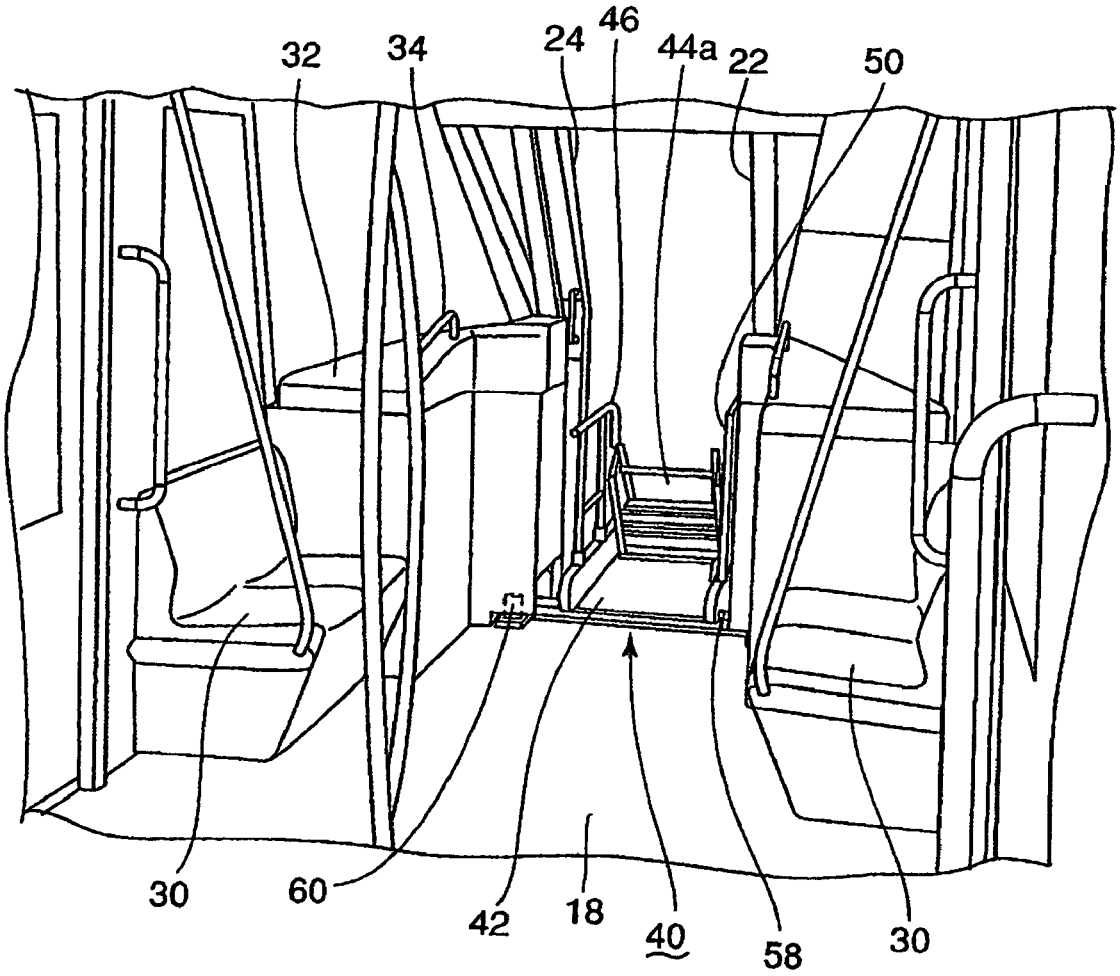
FIG. 6F shows a perspective view of the emergency staircase when the step forming members is developed and landed.
Figure 11:
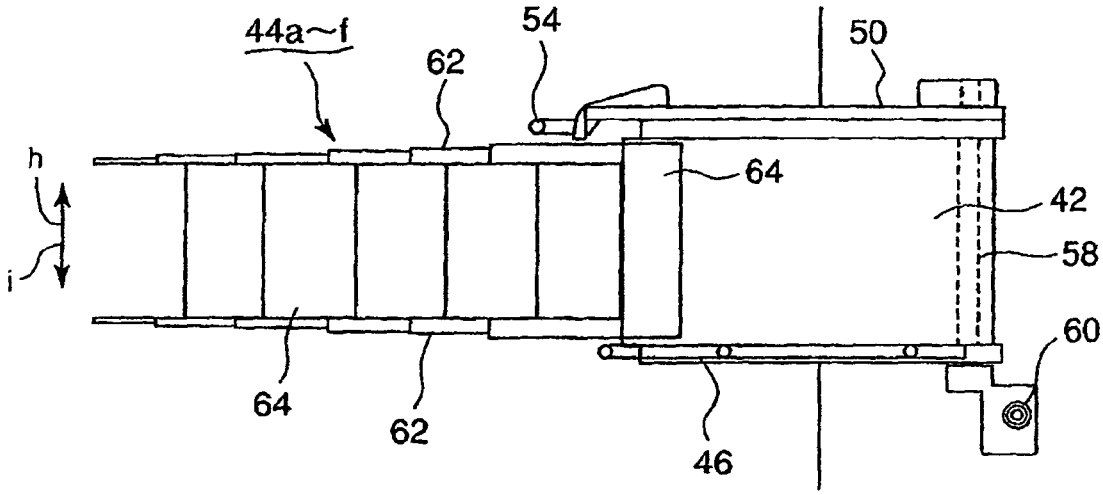
FIG. 11 shows a top view of the emergency staircase when the step forming members is developed and landed.

Still further, the step forming members from 44*a* to 44*f* are rotated around the hinge-pin (not shown) of the hinge 72; each of the step forming members 44*b* to 44*f* is made slide in the g-arrow direction in FIG. 10, by the weight of the members 44*b* to 44*f*, so that the innermost step forming member 44*f* is landed on the guideway surface T; the situation when the member 44*f* is landed on the ground is depicted in FIGS. 10, 11, and 6F. A rope-fitting ring 84 is fastened to the railing 46 and a rope-fitting ring 82 is fastened to a leading end of the outermost step forming member 44*f*; a length of rope 86 is stretched between the rings 82 and 84 so that the landing position can be adjusted. In addition, the slope angle of the step forming-members 44*a* to 44*f*, against the guideway surface T can be adjusted by means of adjusting the size (length) of the rope 86; for example, a setting slope of 45 degrees can be arranged as depicted in FIG. 10.

According to the above-described first embodiment of the present invention, the cross section of each guiding part 62 is of a squarish (an angular) U-shape; a set of adjacent guiding parts 62 forms a similar figure, thereby the size of the inner adjacent guiding part is smaller than that of the outer adjacent guiding part, by the plate thickness of the guiding part 62; the linear protrusions 66*a* and 66*b* are formed at each guiding part 62 except the guiding part of the innermost step forming member 44*f*, along the longitudinal slide-direction, so that the adjacent guiding parts 62 can slide relatively on each other. Therefore, a smooth sliding movement of the guiding parts 62 can be achieved, as well as, the relative distance between the adjacent guiding parts 62 can be kept small.

Thus, the number of the step forming members can be increased, without an increased housing space for the members; accordingly, the number of footsteps can be increased, and the distance between the footsteps can be decreased; further, with the increased number of the footsteps, the slope of the stairway, that is formed by the extended step forming members, against the guideway surface T can be gentle; furthermore, the width of the footstep can be increased.

As described above, since the slope of the stairway is gentle, the passengers get out of the train, with a feeling of security; moreover, since the width of the footstep can be increased with the increased number of the footsteps, the rigidity of the stairway can be enhanced; accordingly, since the stairway can be less easy to bend, the passengers can descend the stairway in an easier and more carefree manner.

Further, since the clearance between the adjacent guiding parts 62 is controlled by the linear protrusions 66*a* and 66*b* that are provided on the guiding parts 62, it becomes easy to prevent a foreign substance from entering the clearance.

Further, in the first embodiment as described above, at first, the casing 42 that houses the step forming members 44*a* to 44*f* is rotated around the level axis 58 so that the casing is laid down on the floor 18 of the coach; secondary, the step forming members 44*a* to 44*f* are rotated around the hinge-pin of the hinge 72, against the casing 42, while the members 44*b* to 44*f* slide down so that the member 44*f* lands on the ground T. Thus, the stairway is formed; accordingly, an operator of the emergency staircase 40 can do without heavy lifting between the moment the members 44*a* to 44*f* are housed in the casing 42 and the moment the members are landed on the ground T; what is more, the time required in operating the emergency staircase can be short, and the operation is simple.

Moreover, after the casing 42 is laid down on the floor, the podium 50 and the railing 46 are set up and fixed in the vertical direction so as to sandwich the escape passage; thus, the podium 50 and the railing 46 can protrude the outward of the train. Therefore, the passengers can hang on the podium or the railing, in descending the stairway; and, the passengers can get out of the train with a feeling of safety. In addition, the rail 54 annexed to the podium 50 helps the passengers easily descend the stairway.

Further, in normal times when the step forming members 44*a* to 44*f* are housed in the casing 42, and the emergency staircase 40 is installed upright, the podium 50 serving as a cover for the staircase 40 as well as an inner wall of the train front; thus, the beauty of the coach inside can be not spoiled.

Still further, the casing 42 is provided so that it can rotate around the vertical axis 60 that is placed on one side of the casing 42; thus, the emergency exit 22 can be promptly accessed, serving as not only a useful exit but also an entrance for a rescue operation in an emergency.

Second Embodiment

Figure 12:
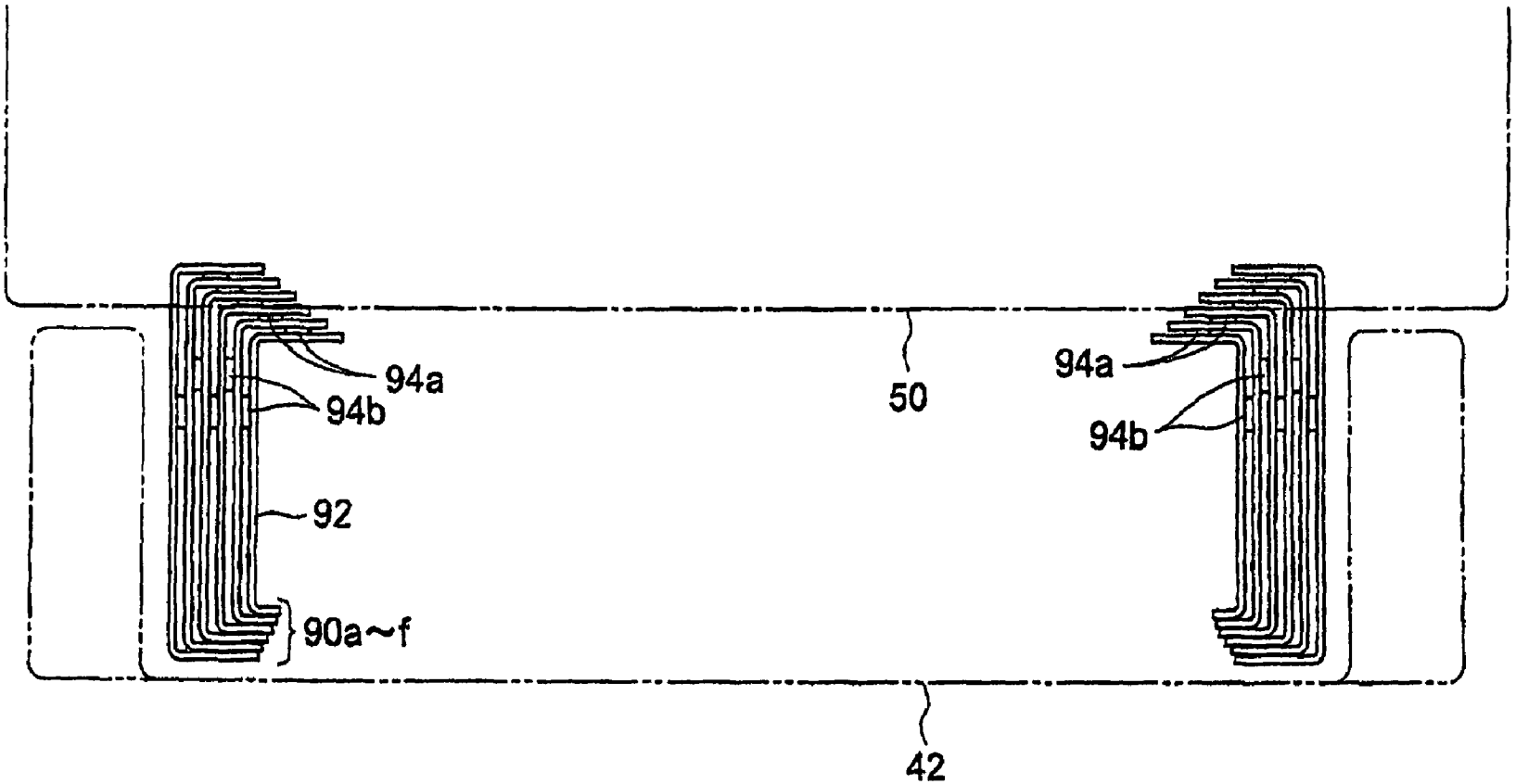
FIG. 12 shows a front view of a plurality of step forming members in the emergency staircase, the view being seen from the outside of the train when the staircase is laid down in a lateral direction.

The second embodiment according to the present invention is hereby explained based on FIG. 12. As depicted in FIG. 12, the emergency staircase of the second embodiment comprises a plurality of step forming members 90*a* to 90*f*; the guide pars 92 for the step forming members except an innermost step forming member 90*f*, namely, for the step forming members from 90*a* to 90*e* is provided with a set of sliding plate strips 94*a* and 94*b*, whereby the sliding plate strips 94*a* and 94*b* serve as the substitutes for the linear protrusions 66*a* and 66*b* in the first embodiment; and, the fitting positions of the sliding plate strips 94*a* and 94*b* are placed substantially at the same positions where the linear protrusions 66*a* and 66*b* are placed in the first embodiment; in other words, the sliding plate strips 94*a* and 94*b* are placed along the longitudinal direction of the step forming members 90 so that the sliding plate strips adhere to the inner side surfaces of the guiding parts 92.

In detail, the sliding plate strips are made of low friction coefficient materials such as PTFE (polytetrafluoroethylene) or nylon; or, the sliding plate strips are made of elastic materials such as rubber.

Apart from the parts as to the above-described sliding mechanism, the parts in the second embodiment follow those in the first embodiment.

According to the second embodiment as described above, even though the emergency staircase is vibrated by the train running movements in normal times when the step forming members are housed in the casing, metallic noises do not occur from the emergency staircase; thus, a quiet environment in the coach can be achieved, the passengers being free from discomfort. Further, when the step forming-members 90*a* to 90*f* are used and made slide, an easy operation can be achieved, since the members 90 easily slide thanks to the low friction.

When PTFE or nylon is adopted as a material for the sliding plate strips, a lubricant such as grease or a solid type lubricant can be dispensed with; the passengers can be free from cares about getting soiled, during detrainment. Further, the sliding plate strips made of PTFE or nylon can be configured as a considerably thin plate strip; thus, the clearances among the guiding parts 92 can be kept small; as a result, the thickness as to the guiding parts 92 and the step plates 64 can be increased, as well as the rigidity thereof can be enhanced.

In addition, a self-lubricating resin can be used for the sliding plate strips 94*a* and 94*b*; for example, a fluorocarbon resin such as PTFE, or a silicone resin containing a silicone polymer as a main component can be used. These self-lubricating resins have low friction characteristics without oil supply, and cannot cause any lubricant smear.

The present invention provides an emergency staircase, whereby an operator can promptly and easily operate the staircase in an emergency, and the passengers can detrain with a feeling of security.

What is claimed is:

1. An extendable staircase installed to a vehicle proximate an opening of the vehicle, comprising:

a plurality of staircase step forming members, each of the staircase step forming members comprising:

a pair of guide parts arranged at a distance and in parallel with each other, a step plate interposed between the pair of guide parts, and a protrusion provided in at least one of the guide parts adjacent two of the step forming members at a contacting portion between the guide parts adjacent two of the step forming members, the pair of guide parts each having a squarish U-shape cross-section, and arranged such that recesses of the squarish U-shapes of the pair of guide parts face each other, the step plate connecting the pair of guide parts so as to transverse the pair of guide parts diagonally and have each end of the step plate extend to a recess of the squarish U-shape of each of the pair of guide parts;

wherein the guide parts of adjacent two of the step forming members have sizes that are different by thicknesses of one of the guide parts, and wherein the staircase step forming members form stairs extending toward a guideway surface by sliding the step forming members with respect to each other.

2. The extendable staircase for a vehicle according to claim 1, wherein said protrusion includes a pair of protrusions respectively provided on an upper side and a lateral side of an inner surface of a first guide portion of the guide parts so that the pair of the protrusions protrudes toward and engages a flat surface of a second guide part of the guide parts that is arranged inside the first guide part.

3. The extendable staircase for the vehicle according to claim 1, further comprising:

a pin provided in the guide parts belonging to one of adjacent two step forming members, and a long slit into which the pin is loosely fitted, the long slit being formed in the guide parts associated with another of the adjacent two of the step forming members, the long slit extending in a longitudinal direction of the guide parts.

4. The extendable staircase for a vehicle according to claim 1, wherein:

a casing that houses the plurality of step forming members is adapted to be rotated about an axis and laid down on a floor of the vehicle at the opening of the vehicle, an uppermost step forming member is supported by the casing so as to be rotatable with respect to the casing around a hinge-pin of a hinge connecting the casing and the step forming members, and the extendable staircase is configured so that after the casing is laid down, the plurality of step forming members is adapted to be rotated along with the uppermost step forming member, and further adapted to telescopically extend down toward the guideway surface.

5. The extendable staircase for a vehicle according to claim 4, wherein the casing comprises:

a foldable podium, and foldable railings that are raised to a vertical position when the casing is laid down on the floor, the foldable railings defining right and left sides of an escape passage respectively; and wherein the podium serves as a storage cover for the extendible staircase when the step forming members are housed in the casing.

6. The extendable staircase for a vehicle according to claim 4, wherein the casing is configured to be rotated around a vertical axis that is located on one side of the casing.

7. The extendable staircase for a vehicle according to claim 5, further comprising a guide rope which is stretched from the podium to a lowermost step forming member of the plurality of the step forming members.

8. The extendable staircase for a vehicle according to claim 1, wherein the protrusions comprise a low friction material or an elastic material.

9. The extendable staircase for vehicle according to claim 8, wherein the low friction material comprises polytetrafluoroethylene.

* * * * *